US009173033B1

(12) United States Patent
Lin et al.

(10) Patent No.: US 9,173,033 B1
(45) Date of Patent: Oct. 27, 2015

(54) COMPOSITE VIBRATION DIAPHRAGM AND ITS FABRICATION METHOD

(71) Applicant: MERRY ELECTRONICS (SUZHOU) CO., LTD., Suzhou City, Jiangsu Province (CN)

(72) Inventors: Ching-Lan Lin, Taichung (TW); Chen-Mao Yang, Taichung (TW); Po-Yu Chen, Taichung (TW); Feng-Min Lai, Taichung (TW)

(73) Assignee: MERRY ELECTRONICS (SUZHOU) CO., LTD., Suzhou, Jiangsu Province (CN)

( * ) Notice: Subject to any disclaimer, the term of this patent is extended or adjusted under 35 U.S.C. 154(b) by 0 days.

(21) Appl. No.: 14/454,956

(22) Filed: Aug. 8, 2014

(51) Int. Cl.

| | |
|---|---|
| ***H04R 7/00*** | (2006.01) |
| ***H04R 7/12*** | (2006.01) |
| ***H04R 31/00*** | (2006.01) |
| ***B05D 3/02*** | (2006.01) |
| ***B05D 3/00*** | (2006.01) |
| ***B05D 5/00*** | (2006.01) |

(52) U.S. Cl.
CPC ..... *H04R 7/125* (2013.01); *B05D 3/007* (2013.01); *B05D 3/0254* (2013.01); *B05D 5/00* (2013.01); *H04R 31/003* (2013.01); *H04R 2307/023* (2013.01); *H04R 2307/027* (2013.01)

(58) Field of Classification Search
CPC ..... H04R 7/00
See application file for complete search history.

(56) References Cited

U.S. PATENT DOCUMENTS

| | | | | | |
|---|---|---|---|---|---|
| 4,122,314 | A * | 10/1978 | Matsuda et al. | ..... | 381/425 |
| 4,395,597 | A * | 7/1983 | Suzuki et al. | ..... | 181/170 |
| 5,102,729 | A * | 4/1992 | Yamaguchi et al. | ..... | 442/147 |
| 6,334,504 | B1 * | 1/2002 | Sato et al. | ..... | 181/167 |
| 2006/0266577 | A1 * | 11/2006 | Inoue et al. | ..... | 181/167 |
| 2007/0190881 | A1 * | 8/2007 | Shibaoka et al. | ..... | 442/228 |
| 2009/0074228 | A1 * | 3/2009 | Mango et al. | ..... | 381/432 |
| 2011/0272208 | A1 * | 11/2011 | Shen | ..... | 181/170 |

FOREIGN PATENT DOCUMENTS

| | | | | | |
|---|---|---|---|---|---|
| JP | 63280600 | A * | 11/1988 | ..... | H04R 7/02 |
| JP | 2003319491 | A * | 11/2003 | ..... | H04R 7/02 |

* cited by examiner

*Primary Examiner* — Forrest M Phillips
(74) *Attorney, Agent, or Firm* — Bacon & Thomas, PLLC

(57) ABSTRACT

A composite vibration diaphragm fabrication method includes the steps of: (a) mixing a reinforcing material with a hot melt adhesive to form a first mixture and to let the reinforcing material be wrapped in the hot melt adhesive uniformly, (b) mixing the first mixture with a thermosetting adhesive to form a second mixture, (c) coating the second mixture on a vibration diaphragm material and then heating the second mixture coated vibration diaphragm material, and (d) cooling down the coated vibration diaphragm material in which the second mixture is cured and bonded to the vibration diaphragm material. Thus, when baking the second mixture, the internal hot melt adhesive will be melted and integrated with the thermosetting adhesive, and the thermosetting adhesive will also be cured, enabling the reinforcing material to be uniformly bonded to the vibration diaphragm to reinforce the strength and rigidity of the composite vibration diaphragm.

5 Claims, 1 Drawing Sheet

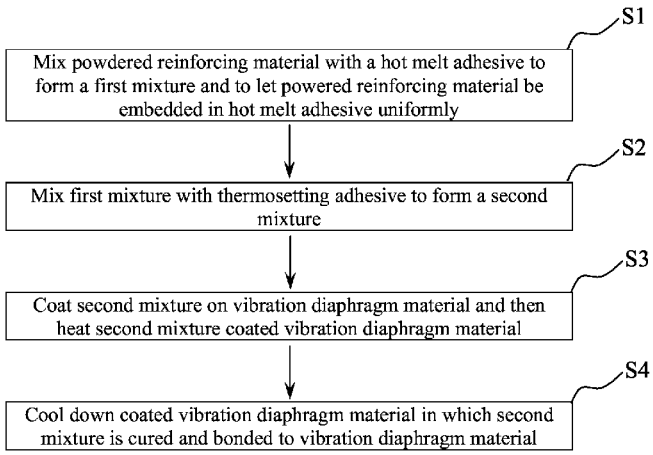

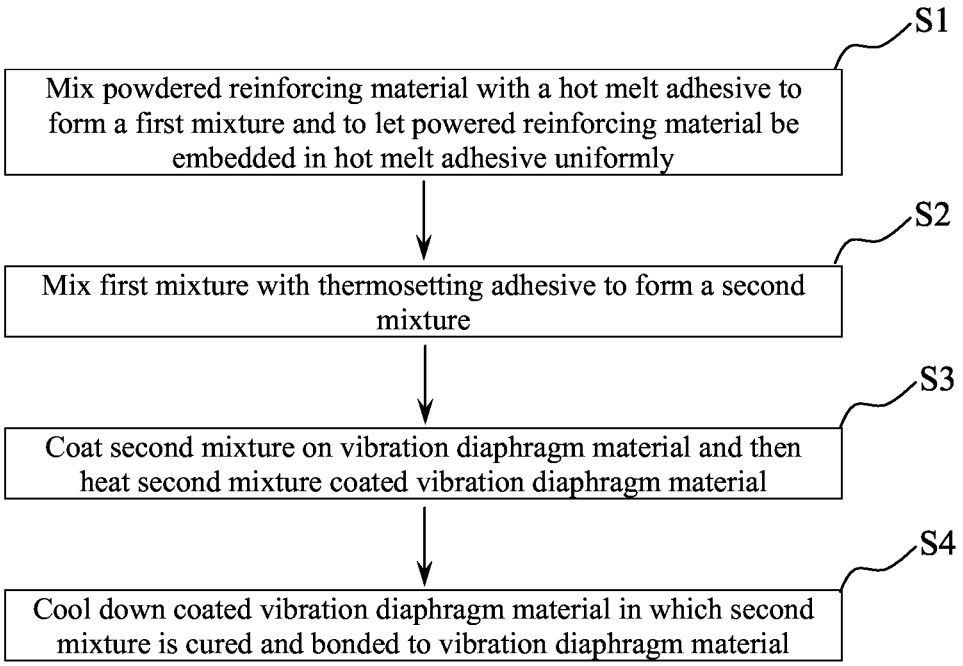
S1
Mix powdered reinforcing material with a hot melt adhesive to form a first mixture and to let powered reinforcing material be embedded in hot melt adhesive uniformly
S2
Mix first mixture with thermosetting adhesive to form a second mixture
S3
Coat second mixture on vibration diaphragm material and then heat second mixture coated vibration diaphragm material
S4
Cool down coated vibration diaphragm material in which second mixture is cured and bonded to vibration diaphragm material

COMPOSITE VIBRATION DIAPHRAGM AND ITS FABRICATION METHOD

BACKGROUND OF THE INVENTION

1. Field of the Invention

The present invention relates to composite vibration diaphragm technology and more particularly, to a method for making a composite vibration diaphragm by utilizing the integratable characteristic between a hot melt adhesive and a thermosetting adhesive to let a powered reinforcing material be uniformly bonded to a vibration diaphragm.

2. Description of the Related Art

The development of smart phones leads to the development trend of micro speaker. In order to output sounds having superior acoustic characteristics, a variety of diaphragm materials have been continuously developed. Some of speakers adopt a composite diaphragm design.

The conventional method for making a composite vibration diaphragm is achieved by: (a) mixing alumina, silica, carbon nanotubes or any other reinforcing material uniformly in an adhesive (such as epoxy resin or any other thermosetting resin); (b) subsequently applying the mixture on the surface of a diaphragm material, and then baking the mixture coated diaphragm material in a hot air oven to cure the reinforcing material and the thermosetting resin; and (c) finally cooling down the composite vibration diaphragm thus obtain. However, because said reinforcing material is porous nano powder particles, it exhibits very poor adhesion to adhesive. Thus, the reinforcing material may drop from the vibration diagram material easily upon a severe vibration or impact of environmental factors, affecting the physical characteristics of the composite diaphragm. Therefore, it is disadvantageous to the acoustic properties of the output sound of the speaker.

SUMMARY OF THE INVENTION

The present invention has been accomplished under the circumstances in view. It is the main object of the present invention to provide a composite vibration diaphragm and its fabrication method, which enables the applied reinforcing material to be fully integrated with the adhesive, preventing dropping from the diaphragm material.

To achieve this and other objects of the present invention, a composite vibration diaphragm fabrication method in accordance with the present invention includes the steps of: (a) mixing a reinforcing material with a hot melt adhesive to form a first mixture and to let the reinforcing material be wrapped in the hot melt adhesive uniformly, (b) mixing the first mixture with a thermosetting adhesive to form a second mixture, (c) coating the second mixture on a vibration diaphragm material and then heating the second mixture coated vibration diaphragm material, and (d) cooling down the coated vibration diaphragm material in which the second mixture is cured and bonded to the vibration diaphragm material.

Thus, when baking the second mixture, the internal hot melt adhesive that surrounds the reinforcing material will be melted and integrated with the thermosetting adhesive, and the thermosetting adhesive will also be cured, enabling the reinforcing material to be uniformly bonded to the vibration diaphragm to reinforce the strength and rigidity of the composite vibration diaphragm and to optimize the acoustic properties of the output sound of the speaker and will not easily drop from the vibration diaphragm.

The invention also provides a composite vibration diaphragm made according to the aforesaid fabrication method. The composite vibration diaphragm comprises a vibration diaphragm material, and a mixture coated on at least a part of the surface of the vibration diaphragm, wherein the mixture comprises a hot melt adhesive, a thermosetting adhesive and a powdered reinforcing material.

Other advantages and features of the present invention will be fully understood by reference to the following specification in conjunction with the accompanying drawings, in which like reference signs denote like components of structure.

BRIEF DESCRIPTION OF THE DRAWINGS

FIG. 1 is a composite vibration diaphragm fabrication flow chart in accordance with the present invention.

DETAILED DESCRIPTION OF THE INVENTION

Referring to FIG. 1, a composite vibration diaphragm fabrication method in accordance with the present invention comprises four steps as follows:

In the first step S1, mix a reinforcing material with a gel-like hot melt adhesive and maintain the temperature of the gel-like hot melt adhesive to let the reinforcing material be embedded in the gel-like hot melt adhesive uniformly, thereby obtaining a first mixture. Wherein the powdered reinforcing material is a nano powder selected from the group of alumina, silica, zirconia, titania, calcium phosphate, aluminum hydroxide, zinc oxide, silicon carbide, fullerenes, carbon nanotubes, graphene and their mixtures; the gel-like hot melt adhesive is selected from the group of cellulose esters, vinyl polymers, polyvinyl alcohol, polyvinyl chloride, polyacrylate, poly a-cyanoacrylate, polyvinyl acetals, polyamides, ethylene-vinyl acetate copolymer and styrene-butadiene copolymer.

In the second step S2, mix the first mixture thus obtained with a gel-like thermosetting adhesive to form a second mixture, wherein the second gel-like hot adhesive is selected from the group of epoxy resins, phenolic resins, urea-formaldehyde resin, melamine-formaldehyde resin, silicone resin, furan resin, unsaturated polyester resin, acrylic resin, polyimide, polybenzimidazole, phenolic-polyvinyl acetal, phenolic-poly amide, phenolic-epoxy and epoxy-polyamide.

In the third step S3, coat the second mixture uniformly on a planar vibration diaphragm material using, for example, a curtain coating technique. As the curtain coating process is of the known art and not within the scope of the spirit of the present invention, no further detailed description will be necessary in this regard. Thereafter, put the second mixture coated planar vibration diaphragm material in a baking oven for baking to cure the second mixture. After the baking step, proceed to the last step S4 to cool down the coated planar vibration diaphragm, thereby obtaining the finished composite vibration diaphragm where the second mixture is cured on the surface of the planar vibration diaphragm.

In the aforesaid third step S3, the coated planar vibration diaphragm material is put in a baking oven for baking to cure the second mixture. Because the reinforcing material is embedded in the gel-like hot melt adhesive and because the gel-like hot melt adhesive and the gel-like thermosetting adhesive have substantially similar material properties, putting the second mixture-coated planar vibration diaphragm material in the baking oven for baking at a high temperature can cause the gel-like hot melt adhesive to be melted and integrated with the gel-like thermosetting adhesive and can also cause the gel-like thermosetting adhesive to be cured. Thus, the reinforcing material and the thermosetting adhesive can be cured and uniformly bonded to the surface of the vibration diaphragm and will not easily drop from the vibration diaphragm. After cured, the reinforcing material can reinforce the strength and rigidity of the composite vibration diaphragm that is formed of the vibration diaphragm material and the second mixture, optimizing the acoustic properties of the output sound of the speaker.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A composite vibration diaphragm fabrication method, comprising the steps of:

(a) mixing a reinforcing material, wherein said reinforcing material is a nano powder, with a holt melt adhesive to form a first mixture and to let said reinforcing material be wrapped in said hot melt adhesive uniformly;

(b) mixing said first mixture with a thermosetting adhesive to form a second mixture;

(c) coating said second mixture on a vibration diaphragm material and then heating the second mixture coated vibration diaphragm material;

(d) cooling down the coated vibration diaphragm material in which said second mixture is cured and bonded to said vibration diaphragm material.

2. The composite vibration diaphragm fabrication method as claimed in claim 1, wherein said reinforcing material is selected from the group of alumina, silica, zirconia, titania, calcium phosphate, aluminum hydroxide, zinc oxide, silicon carbide, fullerenes, carbon nanotubes, graphene and their mixtures.

3. The composite vibration diaphragm fabrication method as claimed in claim 1, wherein said second mixture is coated on said vibration diaphragm material in step (c) using a curtain coating technique.

4. A composite vibration diaphragm comprising a vibration diaphragm material, and a mixture coated on at least a part of the surface of said vibration diaphragm, said mixture comprising a hot melt adhesive, a thermosetting adhesive and a reinforcing material and prepared according to claim 1.

5. The composite vibration diaphragm as claimed in claim 4, wherein said reinforcing material is a nano powder.

* * * * *